US007217104B2

(12) United States Patent
Ross

(10) Patent No.: US 7,217,104 B2
(45) Date of Patent: May 15, 2007

(54) METHOD AND SYSTEM FOR LIQUID LEAK DETECTION, NOTIFICATION AND REMOVAL

(76) Inventor: Carl M. Ross, 1654 Fifth Ave., Bayshore, NY (US) 11706

( * ) Notice: Subject to any disclaimer, the term of this patent is extended or adjusted under 35 U.S.C. 154(b) by 306 days.

(21) Appl. No.: 10/667,577

(22) Filed: Sep. 22, 2003

(65) Prior Publication Data

US 2004/0105758 A1 Jun. 3, 2004

Related U.S. Application Data

(60) Provisional application No. 60/430,303, filed on Dec. 2, 2002.

(51) Int. Cl.
*F04B 37/02* (2006.01)
*F04B 35/04* (2006.01)

(52) U.S. Cl. ..... 417/48; 417/423.14

(58) Field of Classification Search ..... 417/36, 417/411, 40, 48, 410.1, 412, 423.14, 572; 137/192, 392, 2; 604/151, 152, 131
See application file for complete search history.

(56) References Cited

U.S. PATENT DOCUMENTS 3,941,507 A * 3/1976 Niedermeyer ..... 417/2
4,265,262 A * 5/1981 Hotine ..... 137/2
5,305,779 A * 4/1994 Izaguirre ..... 137/172
5,592,030 A * 1/1997 Adahan ..... 307/80
5,923,102 A * 7/1999 Koenig et al. ..... 307/118
6,499,961 B1 * 12/2002 Wyatt et al. ..... 417/36
6,676,382 B2 * 1/2004 Leighton et al. ..... 417/40
2002/0090303 A1 * 7/2002 Scott ..... 417/36
2002/0134132 A1 * 9/2002 Colman et al. ..... 73/1.73

* cited by examiner

*Primary Examiner*—Michael Koczo
*Assistant Examiner*—Ryan Gillan

(57) ABSTRACT

A system for detecting a collection of liquid, notifying a person or thing that liquid has been detected and pumping the liquid. The system includes a control unit, at least one sensor and relay and a pump. Preferably, the system includes a first sensor that senses a collection of liquid which activates a relay which completes an electrical circuit to activate a notification means, such as a siren, light, telephone dialer or other notification device. Preferably, the system also includes a second sensor that senses an additional collection of liquid and thereby activates a second relay which completes an electrical circuit and delivers DC power to the pump which pumps the additional collection of liquid to its desired location. The control unit includes a transformer, relays and plugs to connect to an AC or DC power supply, typically a standard 110 volt AC, 15 amp power supply. The system has a switch in the control unit to allow the pump and other system components to be operated on a DC power supply, such as a car battery. The switch permits the pump to be used as a general utility pump where standard 110 volt AC current is not available. A third relay switch permits automatic switch over to battery power if the control box is connected to an alternate DC power source.

20 Claims, 5 Drawing Sheets

METHOD AND SYSTEM FOR LIQUID LEAK DETECTION, NOTIFICATION AND REMOVAL

This application claims priority to the commonly-titled U.S. provisional application Ser. No. 60/430,303, filed on Dec. 2, 2002, the disclosure of which is incorporated herein by reference.

FIELD OF THE INVENTION

The invention relates to a modular liquid leak detection, notification, and removal system to remove a collection of liquid.

BACKGROUND OF THE INVENTION

Water leakage, floods and liquid overflow conditions can cause significant and permanent structural and property damage. For example, a cesspool overflow can ruin carpeting, flooring and upholstery. Floods, leaks and overflows can short electrical circuits and ruin electrical appliances and components. Cesspool overflow is unpleasant and can be damaging. A toilet flusher may break resulting in a continuous flow of water into a cesspool unbeknown to the occupants of a structure. This continuous flow of water can very quickly fill a cesspool beyond its capacity resulting in flood conditions and the consequential damage to personal property mentioned above.

In some systems, when an overflow condition occurs, an audible alarm, bell, siren or lights becomes activated. If nobody is present, the alarm sound or lights will go unnoticed.

Utility pumps are pumps that are often used in various situations where water or liquid must be drained or moved and which can be used as a standalone pump-apart from any interconnected system. Utility pumps are typically AC powered and typically there are available voltage sources which supply about 110 Volts AC. However, the cost of an AC powered pump is usually much higher than that of a DC powered pump. In addition, one can receive an electrical shock if the conventional, high voltage 110 Volt AC utility pump is exposed to water. Thus, there is a need for a system that uses a low-cost, DC powered pump that can be plugged into a standard AC outlet and used with relative safety to notify a person of a leak and remove the liquid that has been detected.

Heretofore, there were no relatively low-cost, modular systems available which address the problems identified above and which incorporate leak detection, notification, removal and or containment of the liquid from the area in a single inexpensive, functionally—efficient design as does the proposed system as set forth herein.

SUMMARY OF THE INVENTION

One aspect of the invention concerns its ability to integrate each component identified herein in a low-cost, flexible modular system for removal and notification of a collection of liquid. The invention enables the use of various available components in a relatively simple and safe system which includes a pump and at least one liquid sensor, a specifically designed bucket, and other modular components to form a functional system.

The invention is modular in that various components can be added or removed from the system as desired. For example, the system has the capacity to be connected modularly to a notification system and telephone dialer. Also, the system is designed so that the pump may be utilized separate and apart from the water sensor, hose and bucket, with the use of a manual switch which is incorporated into the unit. The liquid detection, notification and removal system has the capacity to be tested periodically to ascertain if all components are working properly.

The pump used in this invention is preferably a low-cost, low-voltage utility pump. The invention preferably includes a low voltage DC pump, powered by AC power, such as 110 volts. Preferably, the pump will be a 12 to 24 volt DC powered pump. This relatively low voltage pump is safer than a higher voltage pump because the risk of receiving a severe shock when the pump is immersed in fluid is lower. In the event no external (AC or DC) power supply is available, another embodiment of the invention allows the pump and peripherals to be operated on battery power, e.g., 12 volt DC power. Thus, the invention provides a measure of convenience, cost-savings and flexibility and safety.

The invention enables the use of a telephone dialer to notify an outside party by telephone that there may be a leak or flood condition. The invention can also be arranged so that a collection of liquid can be sensed and DC voltage can be passed to a pump via a relay. The pump can then transport the liquid into a container or to another location.

In one embodiment of the invention, a transformer/converter (sometimes referred to as a DC transformer) will convert AC power to low voltage DC power, such as, for example, standard 110 Volts AC power to 12 Volts DC power. This low voltage power is used to supply power to the pump and other modular components that may be used, such as a notification means.

Thus, the invention provides the following: 1) low cost liquid leak/flood detection, 2) removal of liquid without a significant risk of a severe electrical shock, 3) an inexpensive means for notifying a person that a collection of liquid has formed, 4) a means for transporting, via a pump, a collection of liquid, 5) modular connections to adapt the base system in a variety of configurations and 6) a means whereby the system pump may be powered by DC battery.

DETAILED DESCRIPTION OF THE INVENTION

Figure 1:
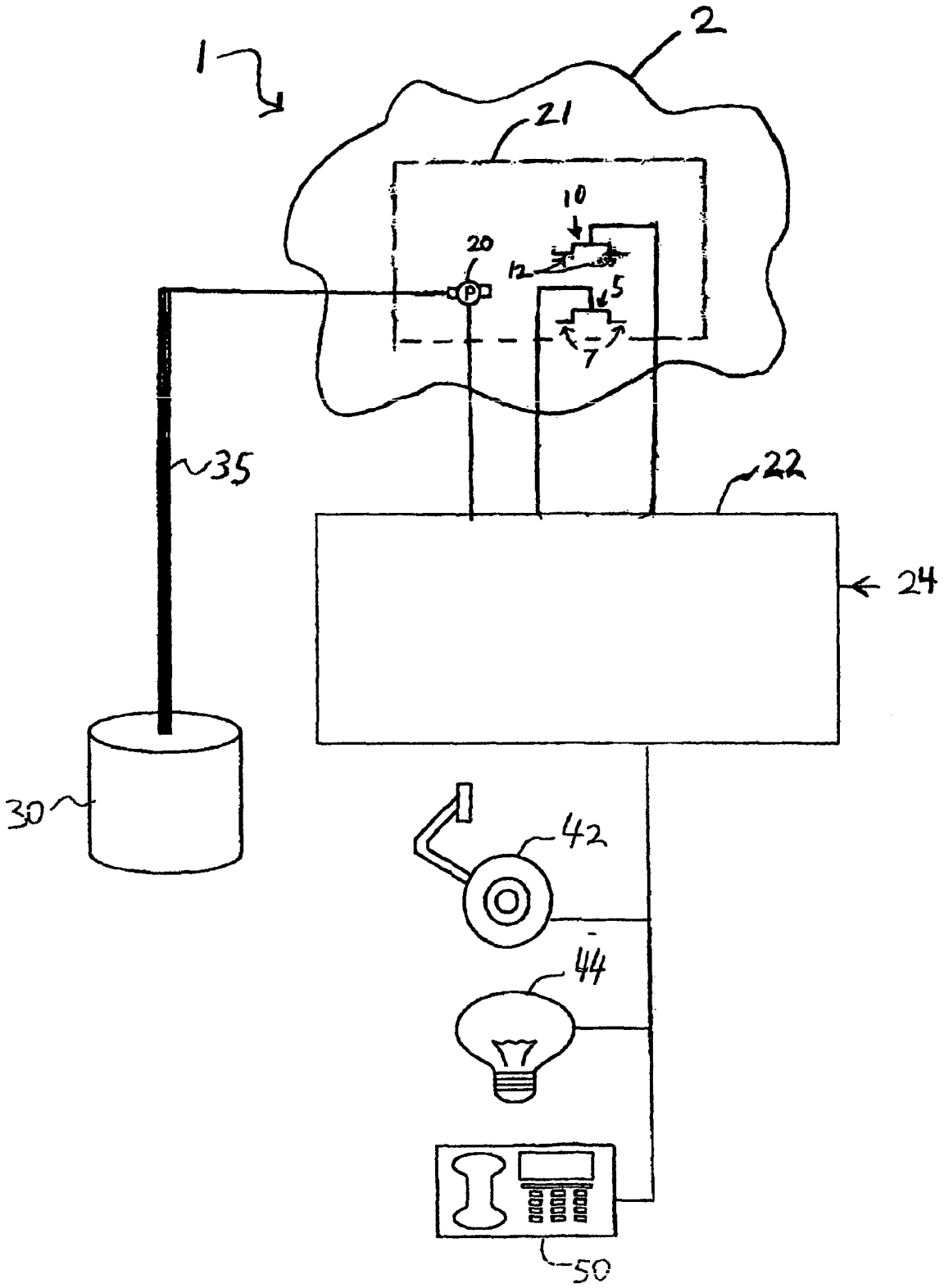
FIG. 1 is a schematic of the components for use with the first embodiment of the flood detection, warning and removal or storage device, wherein the liquid is pumped into a bucket.

The characteristics of the components and the modular manner of their integration in the systems of the invention are described. As shown in FIG. 1, system 1 of the invention shows a modular system which comprises several components, several of which can be added or removed to the system, which can therefore be called modular. FIG. 1 shows a sensor 5, sensor 10, control unit 22, power supply 24, pump 20, hose 35 and bucket 30.

The system is used to collect liquid 2 in bucket 30 or, alternatively, liquid 2 can be diverted elsewhere using pump 20 with a hose 35 that is sufficiently long to divert liquid 2 to its desired location. Pump 20 may be mounted to a bucket 30. Hose 35 preferably is molded for connection to pump 20 and, more particularly, connected to a hose bib, which may be incorporated as an integral part of pump 20.

Figure 4:
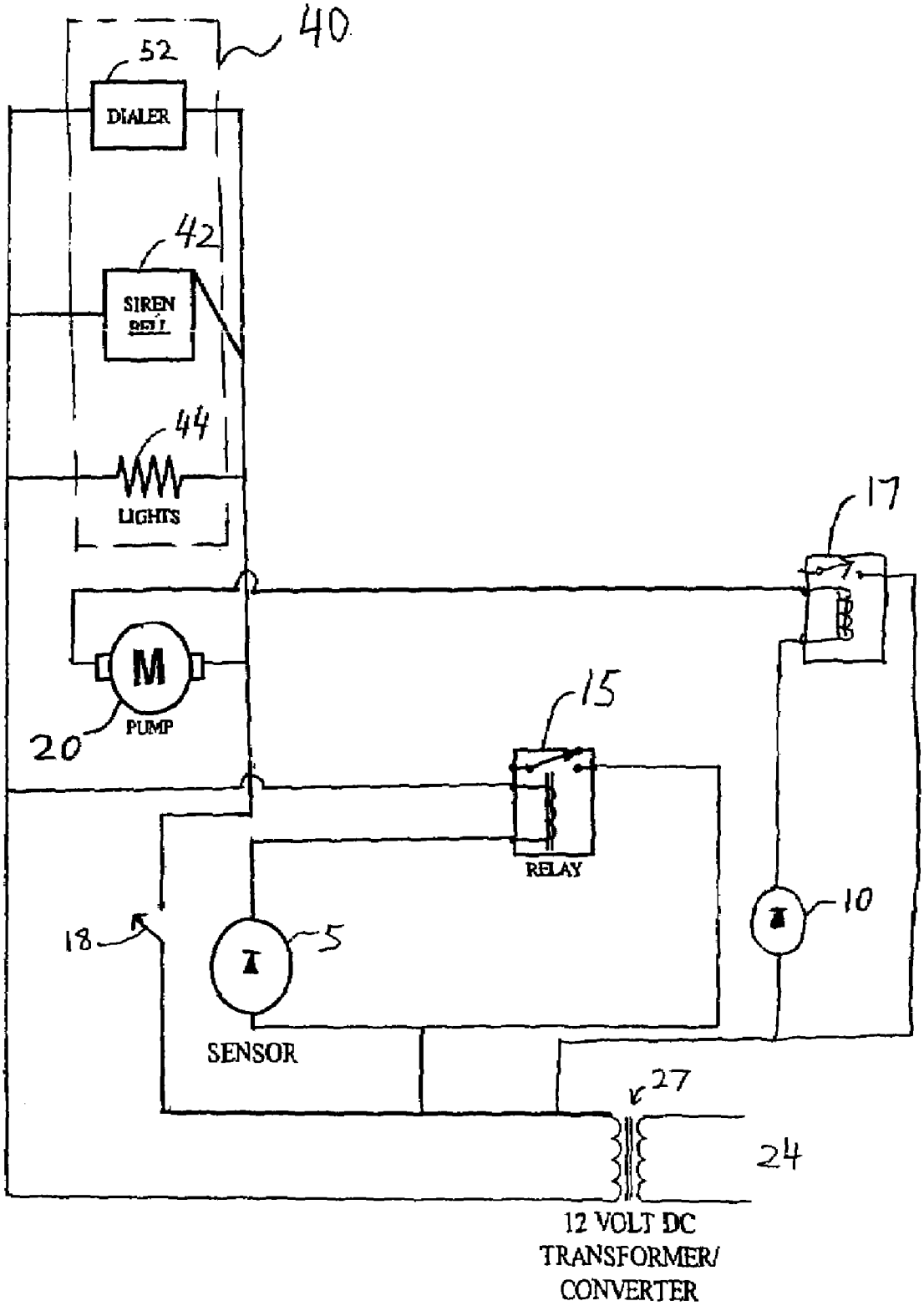
FIG. 4 is a wiring diagram of a first embodiment of the invention.

FIG. 4 is a wiring diagram of the preferred embodiment of the invention. FIG. 4 also shows the following optional components which may be added to the system via the modular electrical connections which will accommodate: audible indicator 42, visual indicator 44 and telephone system 50; together, these three components comprise notification means 40 (FIG. 1). Audible indicator can be siren, bell or other suitable means which can be heard or detected. Visual indicator 44 is preferable a flashing light, although other suitable means can be used. Although not shown, a battery may be used, instead of AC power, to operate the pump and other components, if any are present.

The system enables detection, notification and containment, or removal, of a collection of liquid 2. In addition, pump 20 can be readily detached from control unit 22 and used in other appropriate applications.

Operationally, the system shown in FIG. 1 may function as follows. Sensor 5 detects a small amount of moisture or liquid 2. Sensor 5 triggers a relay 15 which passes electrical power from power supply 24 (not shown) to control unit 22 (described in more detail below). Control unit 22 activates notification means 40 to notify person(s) that liquid 2 has collected. Preferably, notification means 40 will continue to notify person(s) that liquid is present for as long as liquid is detected by sensor 5. In an alternative embodiment, the notification means 40 can be arranged so that it only notifies the user a desired number of times.

If an additional amount of liquid collects, a second sensor 10 will trigger a second relay 17 which passes electrical power to control unit 22 which activates pump 20. Pump 20 causes liquid 2 to flow through hose 35 to either bucket 30, or to a desired location. Once a sufficient amount of liquid 2 has been removed, sensor 10 is deactivated which results in the pump 20 being shut off. Alternatively, pump 20 may be used as a portable utility pump without the need for sensor 5 or 10 to sense liquid.

The sensors 5 and 10, control unit 22, and pump 20 shown in FIG. 1 are described separately below.

Preferably, pump 20 and sensors 5 and 10 are mounted at different vertical positions inside a pump-sensor housing 21, which is shown by the dotted lines in FIG. 1. Housing 21 is preferably made of plastic. Because pump 20 is low voltage and sensors 5 and 10 are essentially waterproof, housing 21 may be submersed in liquid with little risk of electrical shock. Housing 21 will have a sufficient number of holes such that if it is placed in a collection of liquid 2, an initial collection of liquid 2 will come into contact with sensor 5 and an additional collection of liquid will come in contact with a sensor 10 and pump 20. To show the components within it, housing 21 is shown by the dotted lines in FIG. 1.

In FIG. 1, housing 21 preferably should be placed in an area where liquid is likely to collect, such as a low point or near a known leak, a sink, a water tank, a washing machine, a toilet, a plumbing system a water line, or a basement crawl spaces. In industrial conditions, liquids used in various stages of processing, transferring, piping, and storing can result in overflows or liquid spills and that fact may be considered when deciding where to place housing 21. Proper placement of housing 21 allows the system to sense and pump liquid 2. To enhance operation of the system, the user could create a small depression in the floor (preferably about ½ inch depression) so that liquid 2 will flow or sink to this area and can be sensed by sensors 5 and 10 or both and removed by pump 20.

Sensors 5 and 10 preferably use an open collector electronic trigger which simulates a simple dry condition, such that neither sensor is activated in a dry condition. Sensor 5 includes electrical contacts, preferably two contacts 7 which extend horizontally at the same height with respect to the bottom of housing 21 (see FIGS. 1 and 2). Contacts 7 are positioned inside housing 21 at the desired height for sensing and activating notification means 40. The vertical placement of the two contacts 7 of sensor 5 will depend on the application and the minimum level of liquid desired to be detected (for notification). The vertical placement of sensor 5 (and therefore contacts 7) preferably can be adjusted by the user of the system, depending on the urgency of the need to be notified of a collection of liquid. For the typical application of the invention, sensor 5 will be vertically positioned such that its contacts 7 are approximately ⅜ of an inch above the bottom of housing 21. If that is the case, when a moisture or liquid bridge as low as 1/16 of an inch of liquid 2 has collected inside housing 21 such that some amount of liquid makes contact with sensor 5, an electrical condition between contacts 7 of sensor 5 will complete a circuit which sends current to, and activates, an electronic relay switch 15 (FIG. 4), which, if one is present, causes notification means 40 to notify that a collection of liquid has been sensed.

When sensor 5 is activated, electronic relay switch 15 sends current (which passes the switch current), across a wire (not shown) which preferably is plugged in (via a modular plug-in) to control unit 22. Control unit 22 then coordinates activation of notification means 40 which is preferably powered by a low voltage, generally, 12 to 24 volts DC power.

Preferably, assuming an inexpensive sensor is used, sensor 5 operates in conditions where the electric conductivity of the liquid is equal to or greater than the electric conductivity of plain water. This means that water will activate sensor 5 and some liquids, such as saltwater, have a greater capacity to conduct electric current than water and will activate the sensor even more readily than would water. An example of a sensor that may be used with the invention is produced by George Risk Industries, Incorporated in Kimball, Nebr., such as model PS-2800 or model PS-2600.

In the preferred embodiment of the invention, which is shown in FIG. 1, if liquid 2 continues to collect after sensor 5 has been activated, a second sensor, sensor 10, which has two horizontal contacts 12, will become activated. Activation of sensor 10 will cause pump 20 to be activated. Preferably, sensor 10 is the same as sensor 5, which advantageous because, for example, it simplifies the selection of components and potentially lowers costs. Sensor 10, however, is mounted at a higher vertical height within housing 21. Thus, operationally, it will take a deeper collection of liquid 2 to trigger sensor 10 than the depth of liquid required to trigger sensor 5.

As in sensor 5, the vertical position of sensor 10 in housing 21 can be adjusted depending on the application desired and the sensitivity of pump 20. To meet the needs of many household applications and to allow a large number of different types of pumps to be used with the system, contacts 12 of sensor 10 are preferably placed at a vertical height of about ⅜ of an inch above the bottom of housing 21. If that is the case, when a moisture or liquid bridge as low as ⅜ of an inch of liquid 2 forms within housing 21 and some amount of liquid comes into contact with sensor 10, an electrical condition between two sensor contacts 12 of sensor 10 will complete a circuit which sends current to, and activates, a second electronic relay, switch 17 (FIG. 4), which in turn operates pump 20.

In the preferred embodiment of the invention, for as long as sensor 10 is activated (i.e., while contacts 12 complete the bridge of liquid 2), pump 20 will continue to operate to remove liquid 2. This should allow removal of substantially all of the undesirable collected liquid 2, without burning out pump 20, as discussed above. Like the notification means, pump 20 is preferably powered by a low voltage, generally, 12 to 24 volts DC power.

Figure 5:
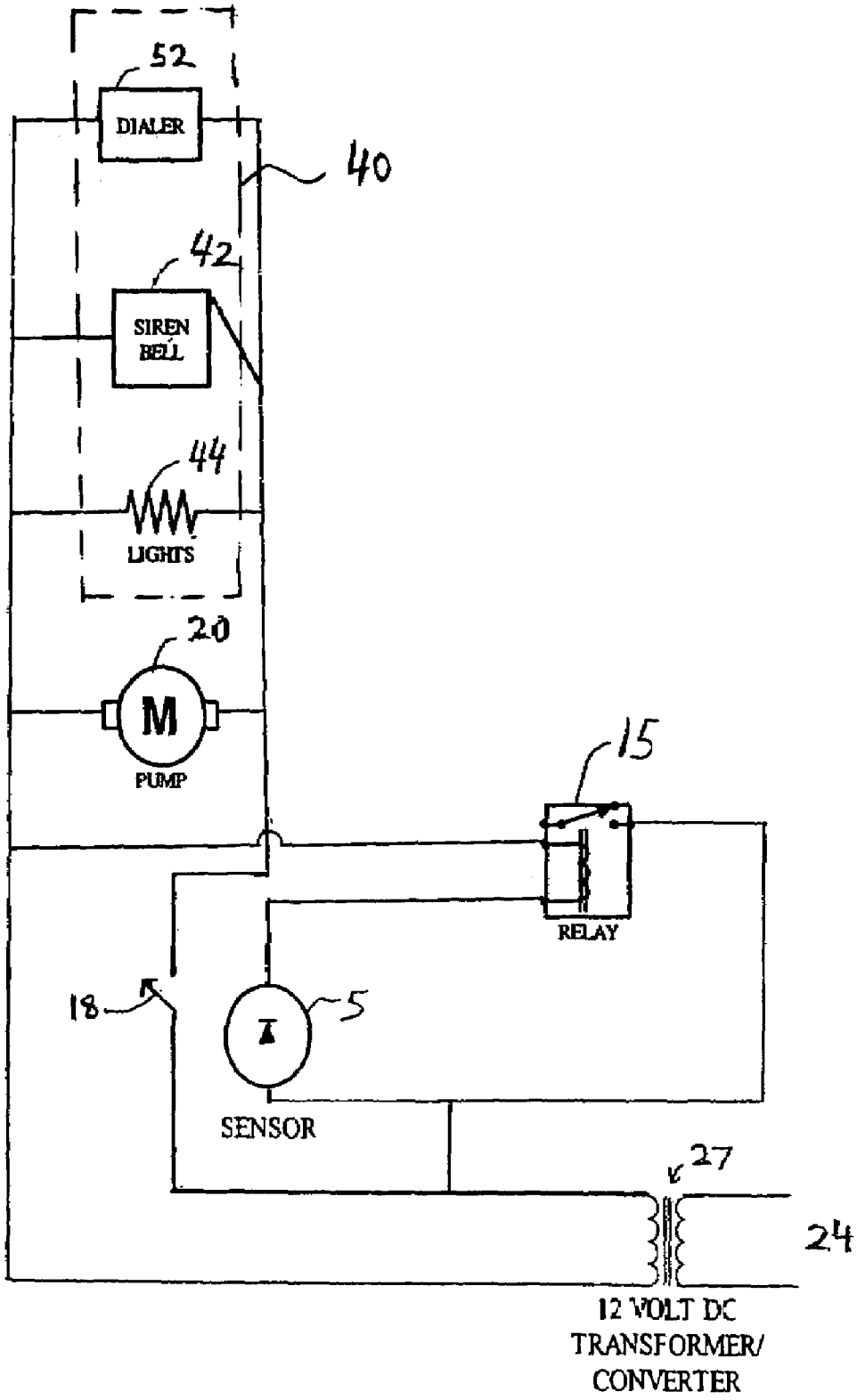
FIG. 5 is a wiring diagram of a second embodiment of the invention.

The preferred embodiment of the invention uses two sensors because having two sensors can provide early notification of a collection of liquid and a later activation of pump when a sufficient amount of water has collected to allow the pump to operate without a substantial risk it will run dry and get damaged. Although a two sensor system is preferred, in an alternative embodiment of the invention, one sensor (e.g., sensor 5) is used to simultaneously activate both the notification means and the pump, as shown in FIG. 5. Depending on the purposes for which it will be used and the pump used in the system, either a single or dual sensor system may be desired and used, consistent with the principles of the invention. In a single sensor system, there is one sensor that activates one relay which simultaneously delivers DC voltage to both the pump and, if present, the notification means 40, which would preferably be connected in parallel (see FIG. 5).

The control unit 22 will be used to control and supply power to notification means 40 and pump 20. Control unit 22 preferably has several modular inputs and outputs for this purpose. Inputs preferably may include an AC supply of power 24, wires from sensors 5 and 10, and plug-ins for an optional DC power supply (preferably 12 V DC) and notification means 40 (e.g., audible indicator 42, such as a siren, and a telephone dialer system 50). Control unit 22 can utilize AC power, such as from a standard 110 volt AC, 15 amp power source (not shown in FIG. 1) or a DC power supply. The DC power supply can be a low voltage battery, preferably 9–16 V DC, more preferably 12 V DC. For example, a typical car batter can be used.

Preferably, control unit 22 comprises a box with a removable front panel (neither is shown in the figures). The front panel includes modular plug-ins to add various devices in modular fashion, including plug-ins for notification means 40 and a DC power supply. Front panel also includes a three-way switch (and relay) to switch the unit to off, AC power on, DC power on. In addition, the front panel of control unit 22 has a manual override switch, in the form of a bypass switch 18, which will bypass sensor 10 thereby activating pump 20. Bypass switch 18 preferably has three positions: on (automatic), off and bypass (manual).

Inside the control unit 22 is included electronic relay switches 15 and 17, bypass switch 18, and power board 24. These components of control unit 22 are housed within a control box housing, which should not be exposed to water since it is typically not watertight and since may transmit 110 volts AC power. Attached to the bottom of the box is a power device 24 and relays 15 and 17. Power device is used to supply electrical power to notification means 40 and to pump 20. Power device 24 includes a board which includes transformer/converter 27 (which can be referred to as a DC transformer). When AC power is being used, transformer/converter 27 is used to change relatively high AC voltage to relatively low AC or DC voltage; for example, generally from 110 volts AC to 12 to 24 Volts DC. This voltage step down increases the safety of the system and enables a low cost, low voltage pump 20 to be used. One example of a suitable power device 24 includes transformer/converter 27 such as model PS 25-12 manufactured by Astrodyne Corporation, Taunton, Mass., although many other suitable units are readily available.

The main output of control unit 22 is a wire, preferably about 10 feet long, which extends from the control unit 22 to housing 21 of pump 20 and sensors 5 and 10. This appropriately long wire allows the control unit 22 to be sufficiently separated from liquid, which may increase safety (e.g., help avoid electrical shock). Although it may be made watertight with some expense, in any case, control box 22 preferably should not be exposed to liquid because of the high voltage it contains and because of the modular plug-ins on its front panel, described above.

Pump 20 is preferably powered by a low voltage supply, preferably 12 volts DC but preferably not more than 24 volts DC, and low amperage power to minimize the risk of electrical shock if pump 20 is exposed to liquid. Preferably, pump is a low-cost pump, such as DC pump which does not operate as a wet vacuum.

Because of the manner in which pump 20 is powered by the control unit 22 and connected, it can be used as a utility pump without the need for sensor 5 or 10 to sense liquid and without activation of notification means 40, as mentioned above with respect to bypass switch 18. Pump 20 does not have to be dedicated to this system and can be used for general utility purposes, not necessarily associated with sensing a collection of liquid 2. The manner of integrating the components used in this system readily allows pump 20 to be used in other applications when needed. In particular, pump 20 can also be detached from bucket 30 and used as any general utility or household pump to transfer or move liquids, independent of the operation of any sensor and bucket. Bucket 30 may be placed in a different area than pump-sensor housing 21. This will provide a means of pumping fluid to another location or larger container for collection.

Pump 20 preferably has sufficient pumping ability to raise liquid 2, preferably, for example, approximately 8 to 10 feet such that pump 20 can be used for a wide variety of household applications such as draining a pool or hot tub. The diameter of hose 35 may be adjusted, however, depending on the pumping power of pump 20 and the desired height needed to raise liquid 2.

Notification means 40 is shown in FIG. 1. Notification means 40 may include audible indicator 42, visual indicator 44 and telephone system 50 (FIG. 4). Audible indicator 42 can be siren, bell or other suitable means, in any combination, which can be heard or detected. Visual indicator 44 is preferable a light emitting components (preferably a flashing light), although other suitable means can be used. Notification means 40 is preferably powered by 12 V DC provided or transformed by control unit 22.

Electric relay switch 15 sends electric current to notification means 40 using a length of electric wire, so that notification means 40 may be placed in a location removed from the vicinity of a collection liquid 2. Each component of notification means 40 can be added or removed, modularly, from the system as the user's preference.

The telephone system 50 appropriate for the invention is described. The telephone system 50 (shown in FIGS. 1–2) includes a dialer 52 (shown in FIGS. 4–5), which may be coupled to an optional telephone 54 (not shown), which may be land-based, cellular or other available technology. Telephone system 50 receives power from electronic relay switch 15 or from an optional DC battery (preferably 9–16 V DC). The telephone system 50 is preferably connected electrically to dialer 52 via a conductive cable, which has a small modular connector on each end. The cable serves as a conduit of low voltage power (preferably 9–16 V DC) and triggering signals for the system to trigger dialer to place a call shortly after sensor 5 has detected a collection of liquid 2, such as from a leak. Dialer 52 may be configured to include a prerecorded announcement. Operationally, when a liquid condition is present and detected by sensor 5, the control unit 22 activates telephone system 50, which sends the correct triggering signal to dialer 52 via the cable. One example of a dialer which may be used is a Linear Security Model PD-2.

Figure 2:
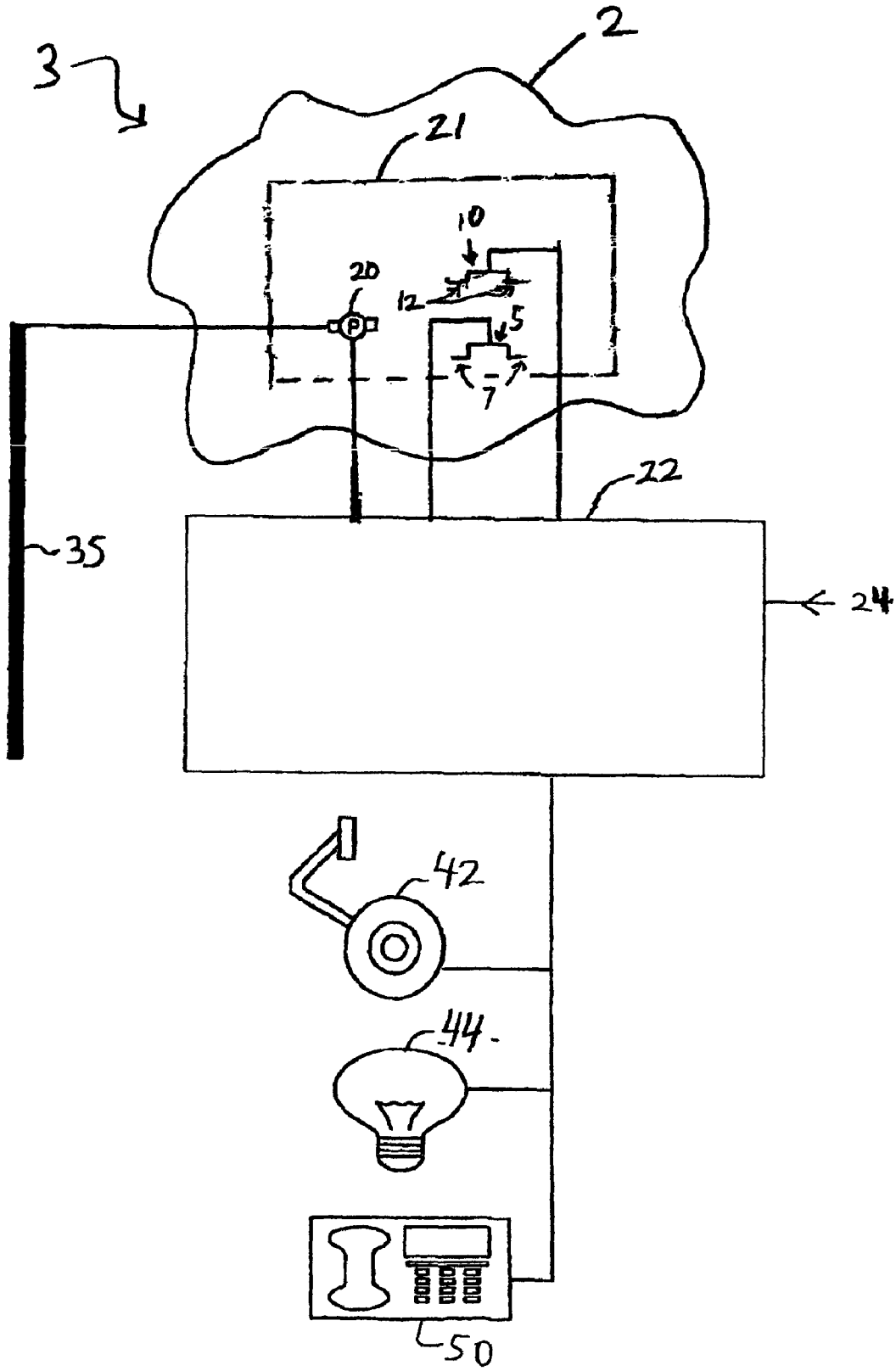
FIG. 2 is a schematic of the components for use with the second embodiment of the device wherein the liquid is pumped via a long hose to a different area for removal or drainage.

FIG. 2 shows the second embodiment of the invention. This embodiment of system 3 does not include a bucket, but instead uses hose 35 of sufficient length to divert liquid 2 to another area. Other than that distinction, the embodiment shown in FIG. 2 contains the same components, connected in the same way as the embodiment shown in FIG. 1.

Figure 3:
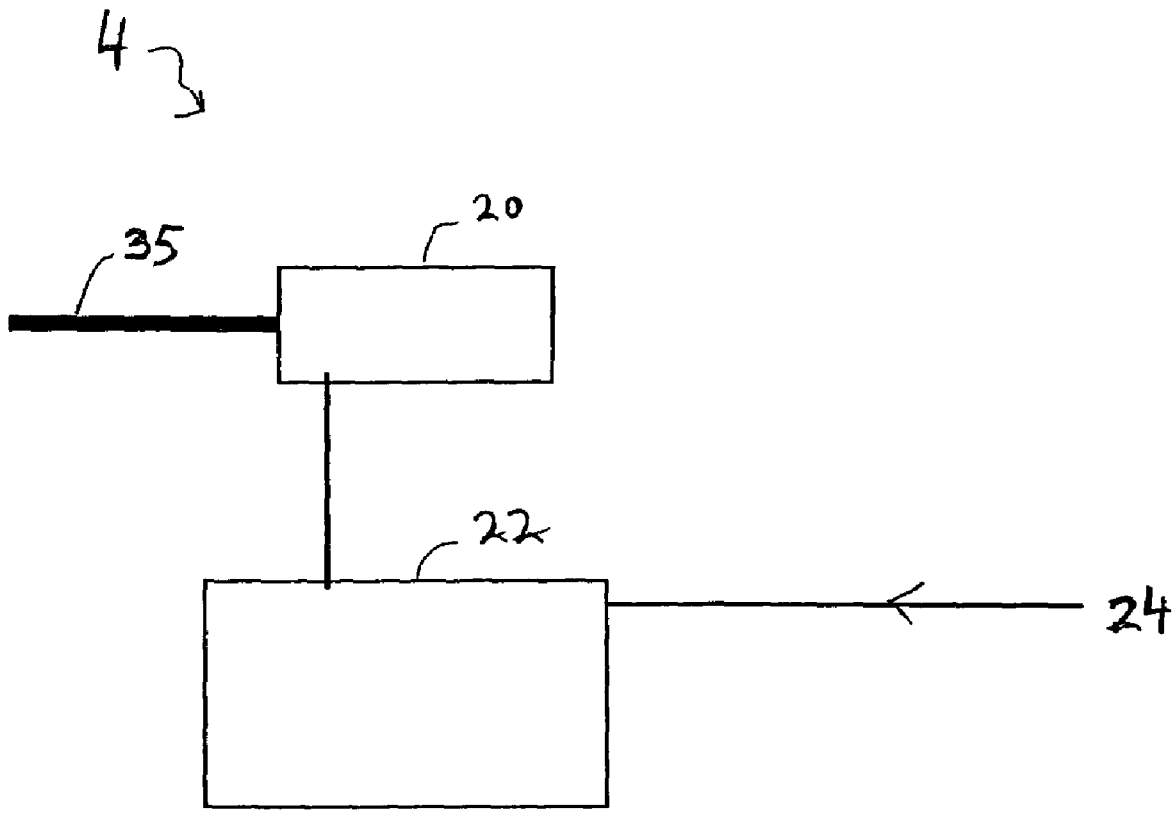
FIG. 3 shows an embodiment of the pump and control unit wherein the pump may be used as a utility pump without the need for sensors 5 or 10 to sense liquid and without notification means.

FIG. 3 shows another embodiment of the invention, system 4, whereby pump 20 is used as a utility pump. Pump 20, control unit 22 and hose 35 are described with respect to the embodiment shown in FIG. 1.

By way of example, FIG. 4 shows a wiring diagram of the preferred embodiment of the invention configured in the following manner. A power supply 24 is a 110 Volt AC or standard house current. Transformer/converter 27 changes power supply 24 to a low voltage DC power, preferably 12 volts (DC). When sensor 5 senses a liquid bridge, current will pass through sensor 5 to electronic switch 15 which sends current to activate notification means 40. As an example, the notification means 40 shown in FIG. 4 includes audible indicator 42, visual indicator 44, and telephone system 50. These three elements are shown connected in parallel to each other because, in the preferred embodiment of the invention, they all utilize the same voltage, preferably 12 volts DC, as a source of power and turn on at the same time. Although this arrangement is preferred, it is not required and the principles of the invention allow more flexibility.

Preferably, components of notification means 40 will continue to be activated for as long as sensor 5 senses a liquid bridge, unless notification means 40 has been manually deactivated. Alternatively, notification means 40 could be activated for an initial period of time or an initial number of times, depending on the users desire.

If fluid continues to collect and reaches contacts 12 of sensor 10 (which are positioned vertically higher than contacts 7 of sensor 5) such that a liquid bridge between contacts 12 is formed, current will pass through sensor 10 to electronic switch 17 which sends current to activate pump 20. Pump 20 will continue to operate until there is no longer a liquid bridge between contacts 12 of sensor 10, which becomes deactivated.

Bypass switch 18 permits pump 20 to be used as a utility pump without operation of sensors 5 or 10 or notification means 40. Pump-sensor housing 21 can be disconnected from control unit 22 and placed near a collection of liquid to be pumped. When placed in bypass mode, bypass switch 18 will send low voltage current directly to the pump 20.

FIG. 5 shows a second embodiment of the invention, whereby a single sensor is used to activate the notification means 40 and the pump 20, as described above.

The foregoing preferred embodiments have been shown and described for the purposes of illustrating the structural and functional principles of the present invention, as well as illustrating the methods of employing the preferred embodiments and are subject to change without departing from such principles. Modifications and alterations will occur to others upon a reading and understanding of this specification. This is especially true given the modular nature of the components that can be used with the invention. Therefore, this invention includes all which modifications and alterations encompassed within the spirit of the following claims.

I claim:

1. A pumping system for sensing and moving liquid comprising:

a liquid sensor for sensing a liquid bridge as low as 1/16 of an inch deep in an area that is not inside a liquid containment vessel and being constructed and arranged to provide an electrical signal when exposed to the liquid;

a control unit comprising a power converter and relay, whereby the power converter converts an input AC voltage to a DC voltage and whereby the relay becomes activated by the electrical signal provided by the sensor; and a pump for moving liquid that has been sensed by the sensor from a first location to a second location, whereby the pump is separate from the control unit and whereby when the relay becomes activated, the pump is powered by the DC voltage output from the power converter.

2. The system of claim 1, further comprising a second liquid sensor which activates a second relay of the control unit, which supplies DC voltage to a notification means for indicating the presence of an initial collection of liquid.

3. The system of claim 2, wherein the notification means comprises at least one of the following: an audible indicator, a visual indicator and a telephone dialer system.

4. The system of claim 1, further comprising a bypass switch for bypassing the sensor so that the pump may obtain power directly from control unit without the need to sense liquid.

5. The system of claim 1, wherein the control unit has an AC power switch to deactivate the AC power supply.

6. The system of claim 5, further comprising a switch having a DC voltage position for allowing the control unit to be connected to a battery which is used to energize the pump.

7. The system of claim 1, wherein the pump can be operated even when sensor has not sensed liquid.

8. The system of claim 1, wherein the pump can be operated from a DC battery source.

9. A method for handling a collection of liquid comprising:

converting an input AC voltage to a DC voltage, using a power converter, whereby the power converter is separate from a pump;

activating a switch when a liquid sensor is in the presence a liquid bridge as low as 1/16 of an inch deep in an area that is not inside a liquid containment vessel;

activating a relay after the switch has been activated;

passing the DC voltage to the pump via the relay; and pumping the collection of liquid to a desired location via the pump.

10. The system of claim 9, further comprising a second sensor, second relay and notification means, whereby the second sensor is for sensing an initial collection of fluid, the second relay is for passing the DC voltage from the activated sensor to a notification means and the notification means is for notifying a person that an initial collection of liquid has been sensed.

11. The system of claim 9, wherein the transformer converts 120 volts AC to 12 volts DC.

12. The system of claim 9 further comprising a bypass switch for bypassing the sensor so that the pump may obtain power directly from control unit without the need to sense liquid.

13. The system of claim 10, wherein the notification means comprises at least one of the following: an audible indicator, a visual indicator and a telephone dialer system.

14. The system of claim 9, further comprising a switch having a DC voltage position for allowing the control unit to be connected to a battery which is used to energize the pump.

15. A system for sensing, notification and removal of liquid comprising:

a transformer that converts a supply of AC voltage to a lower DC voltage, whereby the transformer is separate from a pump;

a first sensor that upon sensing a first collection of a liquid bridge as low as 1/16 of an inch deep in an area that is not inside a liquid containment vessel delivers the DC voltage to a relay;

a first relay that delivers the DC voltage to a notification means to notify that the first collection of liquid has been sensed;

a second sensor that upon sensing a second collection of liquid delivers the DC voltage to a second relay;

the pump that upon activation pumps the second collection of liquid; and a second relay that delivers the DC voltage to activate the pump.

16. The system of claim 15, wherein the transformer converts 120 volts AC to 12 volts DC.

17. The system of claim 16 further comprising a bypass switch for bypassing the sensor so that the pump may obtain power from control unit without the need to sense liquid.

18. The system of claim 15, wherein the notification means comprises at least one of the following: an audible indicator, a visual indicator and a telephone dialer system.

19. The system of claim 10, wherein the notification means comprises a telephone dialer system.

20. The system of claim 15, wherein the notification means comprises a telephone dialer system.

* * * * *